United States Patent [19]

LaBrecque

[11] Patent Number: 4,803,848

[45] Date of Patent: Feb. 14, 1989

[54] COOLING SYSTEM

[76] Inventor: James C. LaBrecque, P.O. Box 214, Farmington, Me.

[21] Appl. No.: 65,306

[22] Filed: Jun. 22, 1987

[51] Int. Cl.[4] ..... F25B 39/04

[52] U.S. Cl. ..... 62/183; 62/173; 62/196.4; 62/510

[58] Field of Search ..... 62/181, 183, 184, 173, 62/90, 510, 196.4, DIG. 17

[56] References Cited

U.S. PATENT DOCUMENTS

| | | | |
|---|---|---|---|
| 2,239,594 | 4/1941 | Cummings, Jr. | 62/173 X |
| 3,151,469 | 10/1964 | Quick | 62/510 X |
| 3,234,749 | 2/1966 | Quick | 62/510 X |
| 3,798,920 | 3/1974 | Morgan | 62/173 |
| 4,437,317 | 3/1984 | Ibrahim | 62/196.4 X |
| 4,589,263 | 5/1986 | DiCarlo et al. | 62/510 X |
| 4,621,505 | 11/1986 | Ares et al. | 62/196.4 X |

FOREIGN PATENT DOCUMENTS

| | | | |
|---|---|---|---|
| 0137841 | 10/1979 | Japan | 62/173 |
| 0041729 | 3/1984 | Japan | 62/173 |

*Primary Examiner*—Harry B. Tanner

*Attorney, Agent, or Firm*—Henry D. Pahl, Jr.

[57] ABSTRACT

In the supermarket cooling system disclosed herein, a variety of evaporative loads having different suction requirements are served by respective compressors, each operating across a corresponding pressure differential but pumping into a common high side header. A single condenser unit serves the combined refrigerant flow from all loads and, from the condenser, the refrigerant flow normally passes through an air-cooled heat reclaim exchanger which is downstream of an air conditioning evaporator in the air conditioning ductwork. The heat reclaim exchanger can be selectively bypassed for certain extreme conditions of operation. By varying the air flows through the condenser unit and the heat reclaim exchanger, a highly efficient thermal operation under the most prevalent conditions is achieved in a very simple hardware configuration.

2 Claims, 2 Drawing Sheets

COOLING SYSTEM

BACKGROUND OF THE INVENTION

The present invention relates to a cooling system and more particularly to a supermarket cooling system in which a plurality of diverse cooling loads are served by respective compressors pumping into a common high side header.

As is understood by those skilled in the art, a modern large scale supermarket typically involves a multitude of diverse cooling demands. Frequently, these diverse demands are met by many separate independent systems, each limited by its own peculiar constraints so that each system is not particularly efficient and there is no overall thermal management so as to minimize the consumption of energy, typically provided in the form of electrical power.

At one end of the spectrum of diverse loads present in the supermarket environment are typically the ice cream cases which must produce an evaporator temperature in the order of −30 degrees F. corresponding to a suction manifold pressure about 9 pounds per square inch. At the other end of the spectrum is typically the air conditioning system where the evaporator temperature will be about 40 degrees F., corresponding to a suction pressure of about 80 pounds per square inch. In between these range extremes are the frozen foods coolers, the meat coolers and the vegetable chillers which require corresponding intermediate evaporator temperatures and suction pressures. These suction pressures are typical for common refrigerant such as R502 and assume a design high side pressure of about 200 psi.

In conventional supermarket architectures, separate refrigerant loops are provided for each type of load, if not for each individual load. Thus, not only are multiple compressors required, but multiple condensers are likewise required, together with any auxiliary valving heat exchange equipment, etc. which may be employed.

As is understood, the thermal efficiency of at least some of the loads can be cost-effectively improved by providing sub-cooling of the refrigerant after condensing. Likewise, for larger systems, some of the heat ejected from the refrigerant may be reclaimed, e.g., for use in reheating the air in the store during the cooler seasons or to provide reheat for dehumidification.

Among the several objects of the present invention may be noted the provision of a cooling system of increased overall efficiency; the provision of such a cooling system which is adapted to serve multiple diverse cooling loads; the provision of such a system of which eliminates the need for respective condensers for multiple diverse cooling loads; the provision of such a system which provides for essentially free sub-cooling of refrigerant without substantially adding to equipment costs; the provision of such a cooling system which provides for heat reclamation in a more efficient and cost effective manner; the provision of such a systemin which air conditioning and refrigeration loads are efficiently integrated; the provision of such a system which is highly reliable; the provision of such a system which is highly efficient overall and is of relatively simple and inexpensive construction.

Other objects and features will be in part apparent and in part pointed out hereinafter.

SUMMARY OF THE INVENTION

Briefly, cooling apparatus in accordance with the present invention employs a common refrigerant system to which a plurality of disparate and diverse evaporator loads are connected, one of the loads being an evaporator for air conditioning. The loads are connected to respective compressors working across different pressure differentials appropriate for the different loads, the outlets of the compressors being connected to a common high side header. An integrated condenser unit is connected to the high side header for receiving the refrigerant therefrom and a variable speed fan is coupled to the condenser unit for controlling the amount of heat rejected from the refrigerant passing through the condenser unit. An air-cooled het reclaim exchanger is connected to receive refrigerant from the condenser and a second variable speed fan or blower is coupled to drive air through the air conditioning evaporator and the heat reclaim exchanger in series for effecting further cooling of the refrigerant passing through the heat reclaim exchanger by the cool air conditioning return air. Control means are provided for varying the speed of the first blower thereby to vary the reheating of air conditioning air circulated by the second blower as a function of the heat available for rejection from the refrigerant at the heat reclaim exchanger.

DESCRIPTION OF THE PREFERRED EMBODIMENT

Figure 1:
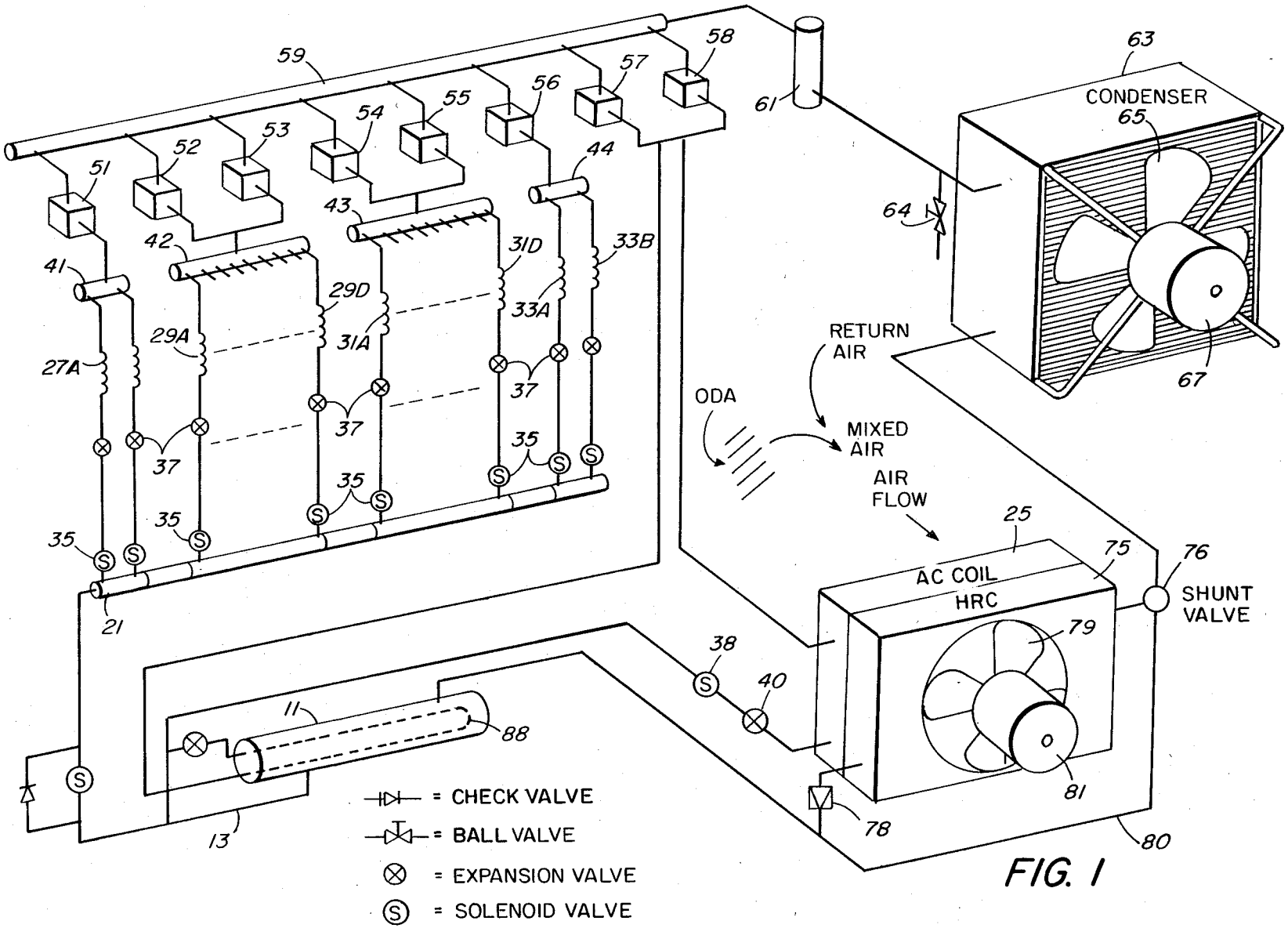
FIG. 1 is a diagramic illustration of cooling apparatus constructed and operable in accordance with the present invention.

Referring now to FIG. 1, condensed and preferably subcooled refrigerant is accumulated or buffered in a receiver 11. As is explained in greater detail hereinafter, receiver 11 is on the high pressure side of the system, i.e., the refrigerant is at a pressure of about 200 pounds per square inch, assuming a normal commercial refrigerant such as R502 is employed. From receiver 11, refrigerant is provided to the various types of loads through a supply line 13 to a liquid line manifold 21.

Evaporative loads serving very low temperature environments e.g., ice cream cases, are indicated at 27A and B. Evaporator loads such as cold cases for dairy and meat products are indicated at 29A–D and 31A–D; while evaporators serving only slightly cooled environments, such as vegetable chillers, are indicated at 33A and B. Each of the loads 27A–B, 29A–D, 31A–D are provided with refrigerant through respective solenoid valves 35 and expansion valves 37 so as to permit each load to be individually controlled, e.g. in response to a respective temperature sensor, so as to maintain an individually preselectable set temperature. Refrigerant from line 13 is also provided, through a solenoid value 38 and an expansion valve 40, to an air conditioning evaporator 25.

The down stream sides of the various evaporative loads of each class are connected to respective suction manifolds, these manifolds being indicated by reference characters 41–44 for the different groups of loads. In order for each of the evaporative loads to work properly, it will be understood by those skilled in the art that the pressure in the respective section manifold should be maintained at a level appropriate for the desired temperature of that load. For example, the manifold 41 might be appropriately maintained at 10 pounds per square inch whereas the manifold 42 might better be maintained at 20 pounds per square inch and the manifolds 43 and 44 maintain that 40 and 50 pounds per square inch respectively.

The desired pressure within each of the suction manifolds 41–44 is maintained by a respective compressor or set of compressors. Preferably the compressors used are of the variable speed type so as to readily accommodate varying system leads. These compressors are indicated at 51–56. A pair of similar compressors 57 and 58 are also provided for pumping from the air conditioning evaporator 25. Though not shown in FIG. 1, each of the suction manifolds is provided with a respective suction pressure sensor. The compressors are controlled in response to the signals provided by these sensors to maintan a selected suction pressure, the suction pressure in turn being selected to correspond to the desired refrigeration temperatures.

All of the compressors 51–58 pump into a common discharge header 59 which constitutes a common high side manifold. From the header 59, refrigerant proceeds, preferably through an oil separator 61, to a single or integrated condenser unit 63. While condenser unit 63 may comprise a plurality of sections, the phrase single condenser unit is meant, in the context of the present application, to mean an integrated condenser system which serves the refrigerant from a plurality of disparate loads having differing requirements. A purge value is provided as indicated at 64. In order to accommodate the widely varying total heat rejection load which may be developed in serving the disparate requirements of the various different loads particularly utilizing the novel mode of operations described hereinafter, air flow through the condenser unit is controlled by a fan or blower 65 which is driven at variable speed by a motor 67. To achieve variable speed efficiently, motor 67 is preferably of the induction type and is driven by an inverter responsive to an analog control signal voltage representing the desired level of air flow. The air driven through condenser unit 63 is outside air and for this reason the condenser unit 63 will typically be roof mounted consistent with conventional practice. While the condenser 63 is basically air-cooled, it should be understood that it may incorporate water spray selectively utilized to increase heat rejection under maximum demand conditions.

Under most operating conditions, the refrigerant leaving condenser 63 passes through a heat reclaim exchanger, designated by a reference character 75, before returning to the receiver 11. However, a three-way valve 76 and a check valve 78 are provided, together with a bypass line 80, so that the heat reclaim exchanger 75 can be selectively switched out of the refrigerant circuit. As is explained in greater detail hereinafter, this is needed only under certain relatively infrequent conditions. The heat reclaim exchanger 75 is downstream of the air conditioning evaporator 25 in the air conditioning duct work. For simplicity of installation, a simple face-to-face arrangement of the two heat exchangers may be utilized, as illustrated in the drawings. A variable flow of air is forced sequentially through the air conditioning evaporator 25 and the heat reclaim exchanger 75 by a second blower or fan 79. Fan 79 is driven at variable speed by a motor 81 which, like the motor 67, is preferably inverter driven so as to control the speed of the fan in response to an analog control signal representing the desired air flow rate.

The air drawn through the air conditioning evaporator 25 and the heat reclaim exchanger 75 is store air, i.e. interior air, though some outside air may be mixed in, as is conventional. As is explained in greater detail hereinafter, exchanger 75 provides both reheat mode air conditioning and sub-cooling of condensed refrigerant to varying degrees depending upon operating conditions so as to permit effective management of overall thermal efficiency.

Depending on climatic conditions, it may also be desirable to include, downstream of the exchanger 75, one or more resistance heaters. The resistance heaters are energized to add heat to the store air when the various other heat sources are insufficient to maintain the store temperature at a comfortable level. Likewise, the A/C ducting may include ventilation louvres to admit outside air to mix with the interior air. Such air is commonly referred to as "make-up" air. Louvers for admitting such outside air are indicated at ODA in FIG. 1.

Refrigerant leaving the heat reclaim exchanger 75 returns to the receiver 11. A small flow of refrigerant, pumped by the air conditioning compressors 57 and 58, is allowed to expand through a coil 88 within the receiver and thereby inhibit unwanted vaporization and pressure build up.

In accordance with the practice of the present invention, the cooling system shown in FIG. 1 is operable in several modes. Switching between modes is determined mainly by climatic conditions affecting the demands on the system and the characteristics of the environment into which heat is to be ejected. While not all of the individual advantages of the system are achievable in all modes, the system provides substantial economies both in terms of thermal efficiency and capital cost based on a full year cycle. Futher, the greatest efficiences are provided in the mode which will be utilized the greatest part of the time.

The three principal modes of operation are: heat reclaim mode; full condensing only; and full condensing with maximum subcooling. Briefly, these modes of operation are as follows.

Heat Reclaim:

Typically, the heat reclaim mode will be most prevalent and it is in this mode that the system arrangements of the present invention provides the greatest advantages. In the heat reclaim mode, an increasing need for heat in the store interior causes, through computerized control, a progressive slowing down of the blower which forces air through the condenser 63. This reduced air flow results in a reduction in the amount of heat rejected from the refrigerant at the condenser and increases the heat available at the reheat exchanger 75 for warming the store interior. At the same time, the control algorithm preferably increases the flow of interior air through the air conditioning evaporator 25 and the heat reclaim coil 75 in a progressive manner. This flow is controlled to maintain a comfortable temperature within the store and to maintain desirable subcooling of the refrigerant leaving the heat reclaim exchanger. Unlike most prior art systems providing some sort of heat reclaiming facility, the present system does not require changing of the path of the refrigerant except under certain relatively unusual conditions. Further, an almost continuously variable control can be effected as contrasted with the more usual step-like operation of the prior art systems.

Full Condensing Only:

This mode will typically be necessary only on the hottest days. Total heat of rejection entering condenser 63 is removed by applying maximum air velocity from the blower. The three-way valve 76 is operated to effectively bypass the heat recovery exchanger 75. Under this condition the amount of refrigerant cooling/subcooling is controlled by the air temperature entering the condenser.

Maximum Subcooling:

The same control conditions as Full Condensing Only occur with some additions. The heat reclaim exchanger 75 is left in the refrigerant circuit and the air conditioning compressors are activated at a dewpoint or air conditioning suction temperature of approximately 40 degrees to 50 degrees. The blower 79 increases the air flow as determined by other primary conditions, such as maintaining the required suction pressures. Since the air conditioning evaporator and heat reclaim exchanger are in series, cold air discharged from evaporator 25 absorbs more heat from the already cooled gas. This increases the enthalpy without additonal subcooling coils, valves and other hardware. This condition exists during air conditioning or dehumidification of the store.

As will be understood by those skilled in the art, the number and types of individual loads will vary from application to application. The principals and basic design of the present invention are, however, applicable to most situations.

As is increasingly common with systems of such complexity, it is appropriate that the control algorithms of a cooling system constructed in accordance with the present invention be implemented by means of a general purpose digital computer, appropriately programmed and provided with suitable sensor input and control output interfaces. Such a digital control system is illustrated diagramatically in FIG. 2. It should also be understood, however, that the control functions could also be implemented by special purpose circuitry, either digital or analog or a hybrid of the two types and that such an implementation would also be within the contemplation of the present invention.

Figure 2:
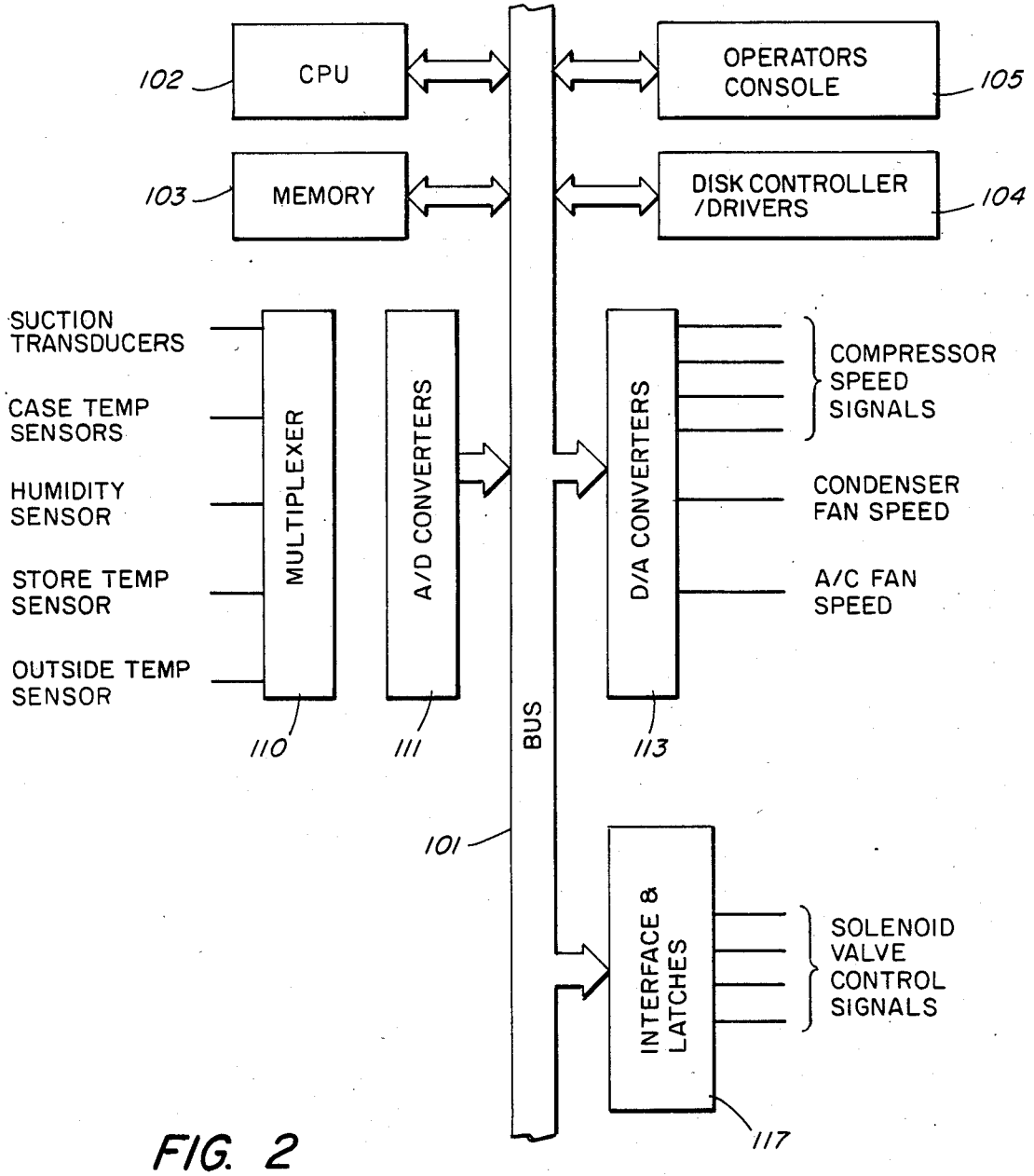
FIG. 2 is a diagrammatic illustration of computer control apparatus used in operating the cooling apparatus of FIG. 1.

In a current implementation of the present invention, the control computer is an eight bit CP/M based system utilizing a Z80 microprocessor, 64K bytes of memory, and suitable parallel interfaces and A/D and D/A converters interconnected through an S-100 system bus. Referring to FIG. 2 where such a control computer is illustrated, the system bus is indicated at 101, the processor at 102, and the random access memory at 103. Disk drives 103 and an operator's console 105 are also provided for booting the system and entering operating parameters as needed. The various sensor inputs, as indicated, are connected, through a multiplexer 110 to an analog-to-digital converter 111 so that the computer can read any of the sensed parameter as needed by the control algorithms. Digital values representing desired speed settings for the various compressors 51–58 and the fans 65 and 79 are applied, by the computer to respective digital-to-analog converters 113 where they are converted to analog signals appropriate for controlling the speeds of the respective motors. Likewise latched parallel interface circuitry is provided as indicated at 117 for controlling the various solenoid values. In addition to providing the control functions employed in the practice of the present invention, the computer also provides a variety of conventional functions which form no part of the present invention and are not described in detail herein, although they are included in the detailed program listing which accompanies this specification. Among these ancillary functions are defrost control, fire alarm monitoring, compressor oil pressure monitoring, control of parking lot lights, nighttime temperature set backs and the like.

The actual control program employed in the actual operation of this system was written in a high level language (FORTRAN), compiled, and then loaded into the computer. However, it will be understood that many other expressions of the basic control concepts taught herein are possible and that the particulr program implementation is in no way critical to the successful operation of the system. The relevant control algorithms as more generally expressed without reference to a particular computer language are as follows.

Overview:

Normal refrigeration mode includes (1.1.1) case temperature control, (1.1.2) suction pressure control, and (1.1.3) compressor control. Case temperature is maintained by controlling the flow of refrigerant to the case. The temperature of the refrigerant is determined by the suction pressure of the compressor. On standard refrigeration systems suction pressure is held constant regardless of the store environmental condition. On this system suction pressure is adjusted by control algorithms according to the enthalpy of the store air, since maintenance of a given case temperature requires more energy in a high enthalpy environment than in a low environment. Suction pressure is in turn controlled by varying the speeds of the compressors. Finally, the system monitors the compressors to assure that they maintain the refrigerant at the proper temperature within defined limits.

It is important to control the temperature and humidity in the store both for the comfort of the customer as well as to improve the efficiency of the refrigeration equipment. As store enthalpy is lowered, less energy is required to cool the cases. As specific humidity is lowered, less ice builds up on the coils, allowing for a reduction in the number of defrosts. Further, reducing the amount of ice on the coils provides for more efficient refrigeration.

At any given time the store is in one of four temperature control modes: (2.2.1) cooling, (2.2.2) heat reclaim, (2.2.3) electric heat, and (2.2.5) heat reclaimation/no ventilation. Cooling is accomplished by the air conditioning compressor and the air handling fan. Return air from the store is blown across the air conditioning coil at a set speed. The amount of coolig is regulated by adjusting the suction pressure (and consequently the coil temperature) of the air conditioning compressor.

Heat reclaimation is accomplished by slowing the condenser fans and speeding up the air handler fans, which blow air across the heat reclaimation coils and in to the store. For most of the year this source is sufficient for all store heating. Periodically the heat reclaim system may not be able to keep up with the heating requirements of the supermarket, so therefore, as the store temperature drops an incremental amount, control algorithm (2.2.5) heat reclaimation/no ventilation will effectively shut off the make up air louver, reducing cold air infiltration by approximately 0.10%. On very cold days heat reclaimation may need to be suplemented by electric heat. For this purpose there are electric heating coils in front of the air handler fan. During the night and on holidays the night setback (2.2.4) lowers the store temperature, decreasing the load on the refrigeration equipment, and allowing cooler return air for more efficient subcooling. The computer will calculate the time necessary to warm up the store before opening and will initiate the heat reclaimation process accordingly.

The coils of the air conditioner are also selectively used for dehumidification when their temperature is set at a level below the dew point of the return air. The amount of dehumidification achieved is determined by controlling the speed of the air handler fans.

On all but hot, humid days or on days when electric heat assistance is required, the ventilation louvers are kept open, allowing fresh air to enter the store through the air handler fans.

1. Refrigeration 1.1 Normal Refrigeration Mode 1.1.1 Case Temperature Control

For each circuit of cases C415 . . . C4k5 on a given compressor there are four operator-installed temperature setpoints:

THA is the high alarm temperature, the temperature above which no case should be operating.

THO is the high operating temperature, the ordinary upper limit on the operating temperature, (known as the cut-in temperature)

TLO is the low operating temperature, the ordinary lower limit on the operating temperature, (known as the cut-out temperature)

TLA is the low alarm temperature, the temperature below which no case should be operating, where TLA<TLO<THO<THA If TCi is the temperature of case Ci as provided by the temperature sensors, the following conditions will cause the corresponding responses.

(A) If MAX Tci>THA, then an alarm is set, assuring that if any one case temperature on the circuit exceeds THA, an alarm is set.

(B) If min TCi>THO, then the liquid line solenoid valve for the circuit is opened, assuring that refrigeration for the circuit will not resume until after all cases on that circuit have reached the high operating temperature, THO.

(C) If min TCi<TLO, then the liquid line solenoid valve for the circuit is closed, assuring that refrigeration will stop as soon as one case on that circuit has reached the low operating temperature, TLO.

(D) If min TCi<TLA, then an alarm is set, assuring that if any one case temperature on the circuit is below TLA, an alarm is set, assuring that if any one case temperature on the circuit is below TLA, an alarm is set.

1.1.2 Suction Pressure Control

For each compressor the operator installs TMFG, the manufacturer's recommended suction temperature, for all the cases on all the circuits for that compressor. The operator is responsible for determining a suction temperature which is appropriate for all cases on that compressor.

Upon installation of TMFG, the values of PFF (TMFG) and PFF (TMFG+"10") are calculated, where PFF (T) is the suction pressure of Freon at saturation corresponding to temperature T. (See Appendix for the specifications for PFF (T).)

The store temperature, T10, and store relative humidity, RH1, are monitored in order to determine the store specific humidity, SSPH (The value of SSPH is equal to SPHF (T10, RH1), the specifications for the function SPHF being given in the Appendix.) The suction pressure P, is then determined by the formula:

$$P = \frac{72 - SSPH}{72 - 36} \times PFF(TMFG + 10) + \frac{SSPH - 36}{72 - 36} \times PFF(TMFG)$$

1.1.3 Compressor Control

Under compressor control the system will:

1.1.3.1 Regulate the speed of compressors 1 through 4 to maintain proper suction pressure as determined in 1.1.2.

1.1.3.2 Monitor the oil pressure for all compressors and take appropriate action if it goes out of limits.

1.1.3.3 Monitor the actual suction temperature for each compressor (Ti through T5) to determine the amount of superheat in the coils, taking appropriate action if it goes out of limits.

1.1.3.4 Monitor high side pressure, P6, taking appropriate action if it goes above limits.

1.1.3.5 Pump down: Shut down any of compresors 1 through 5 when called for. These five compressor control functions are described in detail below.

1.1.3.1 Regulation of Compressor Speed

This function applies only to compressors 1 through 4. It applies only to those compressors which have not been turned off and are not being pumped down (see 1.1.3.5 below). The suction pressure recorded by sensors P1–P4 is compared every "x" units of time to the suction pressure set point calculated in 1.1.2. If the actual suction pressure is "y" or more units below the set points, the compressure speed is decreased one step. If actual suction pressure is "y" or more units above the set point, the compressor speed is increased one step.

1.1.3.2 Monitoring Oil Pressure

This function applies to all compressors, including air conditioning, which are turned on and not being pumped down (see 1.1.3.5 below. Each compressor's oil pressure, as recorded from sensors P01–P05, must be at least "25 pounds" above that compressor's suction pressure, as recorded from sensors P1–P5. If the oil pressure is under this limit for more than "two minutes", an alarm is set and the compressor is pumped down (see 1.1.3.5 below).

1.1.3.3 Monitoring Actual Suction Temperature

This function applies to all compressors which are not turned off and are not being pumped down.

Actual suction temperature for compressor i is recorded as Ti. Actual suction pressure for compressor i is recorded as Pi. The saturated suction temperature corresponding to Pi for a given compressor is obtained by calculating TF (Pi). The amount of superheat on the suction side of compressor i (denoted by SH) is given by the difference:

$$SH = Ti - TF(Pi)$$

If SH exceeds the operator-installed set point SHHA, an alarm is set. If SH is lower than another operator-installed set point SHLA, an alarm is set and the compressor is pumped down, restarted, and the value of SH again compared with SHLA. If necessary, the compressor is pumped down once again. This procedure is repeated at most "k" times, after which the compressor is left pumped down.

1.1.3.4 Monitoring High Side Pressure

The high side pressure is recorded by sensor P6. If at any time P6 exceeds "275" pounds, an alarm is set and all compressors are pumped down.

1.2.1 Specific Humidity Integration

Each time the specific humidity integration is done, the average specific humidity between current time and the last time it was done is computed by:

$$A=(SSPHL+STOSPH)/2$$

where SSPHL is the store specific humidity the last time an integration was done, and STOSPH is the current store specific humidity. This is divided by the "standard" specific humidity, STASPH, which is operator installed, but probably 72 grains per pound of dry air, and multiplied by the time elapsed since the last integration, to get an effective (for ice accumulation purposes) time since last integration.

$$B=(TIME-TSSPHL)^{*}\ A/STASPH$$

For each circuit I, that is not in defrost, the number B is added to INTSPH(I) which is a measure of the amount of effective time that has elapsed since the last time the circuit was defrosted. When this exceeds the manufacturers recommended time between defrost, RECTB(I), either the circuit is put into defrost, or, in the case of hot-gas defrost (see 1.2.4 below), the circuit may be put on a waiting list. Upon completion of defrost, INSTPH(I) is rest to 0.

2. Environment 2.1 Mode determination

At any time this store is one of two humidity control modes and one of four temperature control modes. These modes are described below.

DETERMINATION 2.1.1 Humidity Mode

The two humidity control modes are (A) dehumidification and (B) no-dehumidification.

Transition from one mode to another is determined by comparing store relative humidity, RH1, with two operator installed set points:

$$RHSP2<RHSP1$$

(A) If the store is in the dehumidification mode, it stays there unless RH1<RHSP2, at which time it goes into the no-dehumidification mode.

(B) If the store is in the no-dehumidification mode, it stays there unless RH1>RHSP1, at which time it goes into the dehumidification mode.

DETERMINATION 2.1.2 Temperature Mode

The four temperature control modes are:

(A) cooling (B) heat reclaim (C) heat reclaim/no ventilation (D) electric heat

Transition from one mode to another is determined by comparing store temperature, T10, with four operator-installed temperature set points:

$$TSP4<TSP3<TSP2<TSP1$$

(A) If in the cooling mode, the store stays in the cooling mode unless T10<TSP2, in which case it goes into the heat reclaim mode.

(B) If in the heat reclaim mode, the store stays in that mode unless either:

(1) T10>TSP1, at which time it goes into the heat reclaim mode or (2) T10<TSP3, at which time it goes into the heat reclaim/no ventilation mode.

(C) If in the heat reclaim/no ventilation mode, the store stays in that mode unless either:

(1) T10>TSP3, at which time it goes into the heat reclamation mode or (2) T10<TSP4, at which time it goes into the electric heat mode.

(D) If in the electric heat mode, the store stays in that mode unless T10>TSP4, at which time it goes into the heat reclaim/no ventilation mode.

2.2 Temperature Control 2.2.1 Cooling

In the cooling mode, the air handler fan operates at a fixed max A/C speed installed by the operator. Control of the A/C compressor depends on whether or not the store is in the dehumidification mode. In the dehumidification mode the compressor is controlled to keep the A/C coils at a temperature below the dew point of the return air. This is described under (2.3) humidity control below.

When the store is not in the dehumidification mode, the A/C compressor spread is adjusted to maintain proper store temperature. Specifically, there is a target store temperature, TSTC, for the cooling mode which is set so that TSTC>TSP2. Store temperature (T10) is monitored periodically. If T10>TSTC +"y", then the A/C compressor speed is increased one step. If T10<TSTC−"y", then A/C compressor speed is decreased one step.

While in the cooling mode, the condenser fan runs at full speed.

2.2.2 Heat Reclamation

In the heat reclamation mode, store temperature/(T10) is monitored periodically. An operator-installed target store temperature, TSTH, is set so that TSP3≦TSTH≦TSTC. If T10 >TSTH+"y", then the condenser fan speed is increased one step. If T10<TSTH−"y", then the condenser fan speed is decreasd one step. The condenser fan speed, however, is not increased unless the temperature T7, at the inlet of the reclamation coil, exceeds the temperature T8, at the outlet of the coil, by at least 1 degree.

When the store is not in the dehumidification mode, the air handler fan speed is controlled to maintain the desired amount of subcooling of the liquid in the heat reclamation coils. The high side pressure, P6, is converted using the function TFF into the saturation temperature TFF (P6). The actual temperature, T8, is measured at the outlet of the heat reclamation coil. The difference $$TFF\ (P6)-T8$$

is the amount of subcooling. If TFF (P6)−T8>15 degrees + "y", there is more subcooling than necessary, so the air handler fan speed is decreased one step. If TFF (P6)−T8>15 degrees −"y", there is too little subcooling, so the air handler fan is increased one step.

When the store is in the dehumidification mode, the air handler speed is regulated as described under (2.3) humidity control, below.

2.2.3 Electric Heat

The store is in the electric heat mode when store temperature is less than temperature set point 4.

$$T10 < TSP4$$

The amount of electric heat is goverened by store temperature T10, the set point TSP4, and another set point TSP5 where TSP5<TSP4, and is controlled by the proportion of time that the heaters are turned on.

2.3 Humidity Control

Dehumidification is accomplished by maintaining the suction temperature of the A/C compressor below the dewpoint of the mixed air flow in the air handler fan. The amount of dehumidification is controlled by setting the speed of the air handler fan.

The dewpoint (temperature) of the mixed air flow is $$TSF\ (RH3 \times PSF\ (T12)$$

where T12 is the temperature of the mixed air flow, PSF (T12) is the partial pressure of the water vapor in the mixed air flow, RH3 is the relative humidity of the mixed air flow, and RH3×PSF (T12) is the partial pressure of water at the dewpoint temperature.

To humidify the mixed air flow, the temperature of the A/C coils must be below the dewpoint temperature of the mixed air flow by some amount "x". This coil temperature may be converted to a suction pressure for the A/C compressor by using the function PFF. (See "Mathematical Functions" for the specifications of PFF.) Consequently, the A/C compressor suction pressure should be maintained at:

$$PFF\ (TSF\ (RH3 \times PSF\ (T12)) - \text{"}\times\text{"}).$$

This number is computed periodically and, if it is less than the actual suction pressure (P5), the A/C compressor speed is increased one step. If this number is greater than P5, the compressor speed is reduced one step.

In the dehumidification mode the store relative humidity RH1 is periodically compared with an operator-installed target relative humidity, TRH.

If RH1>TRH+"y", then the air handler speed is increased one step.

If RH1<TRH−"y", the air handler speed is decreased one step. In the event that the store is in the cooling mode, the air handler fan speed should not be set at more than the maximum allowed for air conditioning.

2.4 Ventilation

The make-up air louvers are closed during the heat reclaim/no ventilation mode (2.2.2) and during the electric heat mode (2.2.3).

The louvers also are closed if the outdoor air temperature, T11, is more than 85° F.

The louvers are closed if the outdoor specific humidity is more than 72 grains. The outdoor specific humidity is SPHF (T11, RH2), where T11 is the outdoor temperature and RH3 is the outdoor relative humidity. (See "Mathematical Functions" for the specifications of SPHF.)

MATHEMATICAL FUNCTIONS

The control algorithms make use of five mathematical functions. They are as follows:

1. PFF (T)=corresponding pressure of refrigerant R-502 for a given saturation temperature.

$$PFF\ (T) = A + B \times T + C \times T524 + D \times T534$$

where
A=30.95132
B=0.91604021
C=0.0070919068
D=$2.3866006 \times 10^{-5}$

2. TFF (P)=saturation temperature of refrigerant R-502 for a given saturation pressure.

$$TFF\ (P) = A + B \times P + C \times P524 + D/(E+P)$$

where
A=1071075
B=0.190405
C=−0.000042815

3. PSF (T)=pressure of steam for a given temperature at saturation.

$$P = A + B \times T + C \times T524 + DX\ T534 + E \times T544,$$

where
A=0.069272
B=0.0025393
C=0.000121627
D=$-1.01094 \times 10^{-6}$
E=$9.278154 \times 10$ 4. TSF (P)=saturation temperature of water vapor at a given pressure.

$$TSF\ (P) = A/P524 + B/B + C + D \times P + E \times P524 + F \times P534$$

where
A=0.129345
B=−4.39097
C=59.4236
D=67.4456
E=−24.0002
F=3.6411

5. SPHF (T,RH)=specific humidity-grains of moisture per pound of dry air at a given dry bulb T10 and relative humidity RH,

$$SPHF(T,R,) = 7000 \times .622 \times \frac{PSF(T) \times RH}{1 - PSF(T \times RH)}$$

SUMMARY OF OPERATION AND ADVANTAGES

As indicated previously, the system of the present invention provides the greatest advantages over prior art systems under conditions which are the most prevalent. Under most circumstances, the reheat mode of operation is advantageously applied. In this mode, the speed of the fan driving air through the main condenser unit is varied as a function of store temperature so as to control the amount of heat which is available to be ejected into the air conditioning air flow from the heat reclaim exchanger. The air conditioning compressor is run to provide sub-cooling of the refrigerant in the heat reclaim exchanger. As will be understood by those skilled in the art, this cooling and reheating of the air conditioning air flow provides dehumidification which is typically required in a supermarket context. The speed of the air handling fan in the air conditioning ductwork is preferably controlled to maintain the air conditioning evaporator coil at a temperature just slightly below the dew point.

As is understood by those skilled in the art, the application of sub-cooling typically increases the overall efficiency of the system. Likewise, since the fan driving air through the main integrated condensing unit is speed-controlled to produce only the heat rejection which is necessary over and above that provided by the heat reclaim coil, the system operates at the lowest possible high side pressure consistent with maintaining the stored temperature. As is also understood by those skilled in the refrigeration arts, this maintenance of a minimal high side pressure also works to increase the overall thermal efficiency of the system. A significant saving in energy is also obtained with regard to the amount of electric power required to run the air moving fans or blowers, particularly the main integrated condenser fans, since the power required to run a fan increases substantially according to a cube law in relation to the number of cubic feet per minute moved by the fan.

As also indicated previously, the increase in thermal efficiency does not continue as maximum demand is reached since at that point all system components are being worked to their maximum and the system must necessarily function in essentially the same manner as a conventional prior art system. However, the system of the present invention is still advantageous in such circumstances since there is a reduced capital cost flowing from the use of a single integrated condenser unit which performs the work for both air conditioning and refrigeration.

Another advantage of the present system with respect to other systems employing heat reclaim is that the refrigerant passes through the heat reclaim coil after the condenser. Upon prior art systems where the refrigerant goes through the heat reclaim coils first and then through the condenser, there is a tendency for the condenser to flood, i.e. fill with liquid, on very cold days and thus a relatively large quantity of coolant is required together with a relatively large storage tank for buffering the refrigerant when flooding is not occurring.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. Cooling apparatus comprising:

a plurality of evaporator loads requiring differing suction pressures, one of said loads being an evaporator for air conditioning;

a high side header;

a plurality of compressors working across different pressure differentials appropriate for said differing refrigeration loads, the outlets of said compressors being connected in common to said high side header;

a single condenser unit connected to said high side header for receiving refrigerant therefrom;

a variable speed fan coupled to said condenser unit for controlling the amount of heat rejected from the refrigerant passing through said condenser unit;

an air cooled heat reclaim exchanger connected to selectively receive refrigerant from the output side of said condenser, said reclaim exchanger being provided with valving means for bypassing refrigerant flow around said reclaim exchanger;

means for receiving refrigerant from said condenser unit and said heat reclaim exchanger and for providing refrigerant to said evaporator loads; and a blower coupled to said air conditioning evaporator and said heat reclaim exchanger for driving air through them sequentially for effecting cooling of said reclaim exchanger from said air conditioning evaporator.

2. Cooling apparatus comprising:

a receiver for refrigerant;

a plurality of evaporator loads connected in common to said receiver but requiring differing output pressures, one of said loads being an air conditioning evaporator;

a plurality of said loads being provided with variable flow regulating devices for controlling the amount of refrigerant passing through the load;

a high side header;

a plurality of compressors working across different pressure differentials appropriate for said differing refrigeration loads, the outlets of said compressors being connected in common to said high side header;

an integrated condenser unit connected to said high side header for receiving refrigerant therefrom;

a variable speed fan coupled to said condenser unit for controlling the amount of heat rejected from the refrigerant passing through said condenser unit;

an air cooled heat reclaim exchanger connected to selectively receive refrigerant from the output side of said condenser unit, said reclaim exchanger being provided with valving means for bypassing refrigerant flow around said reclaim exchanger;

a blower coupled to said air conditioning evaporator and said heat reclaim exchanger for driving air through them seqentially for effecting cooling of of said reclaim exchanger from said air conditioning evaporator;

means for receiving refrigerant from said condenser unit and said heat reclaim exchanger and for providing refrigerant to said evaporator loads; and control means for varying the speed of said first fan responsive to air conditoning needs thereby to vary the reheating of air conditioner air circulated by said blower as a function of the heat available for ejection by said heat reclaim exchanger.

* * * * *